US007828177B2

(12) United States Patent
Decottignies et al.

(10) Patent No.: US 7,828,177 B2
(45) Date of Patent: Nov. 9, 2010

(54) DISPENSER HEAD

(75) Inventors: Laurent Decottignies, Cergy (FR); Alain Behar, Suresnes (FR)

(73) Assignee: Airlessystems, Charleval (FR)

( * ) Notice: Subject to any disclaimer, the term of this patent is extended or adjusted under 35 U.S.C. 154(b) by 419 days.

(21) Appl. No.: 11/910,676

(22) PCT Filed: Apr. 3, 2006

(86) PCT No.: PCT/FR2006/050287

§ 371 (c)(1),
(2), (4) Date: Oct. 4, 2007

(87) PCT Pub. No.: WO2006/106256

PCT Pub. Date: Oct. 12, 2006

(65) Prior Publication Data

US 2008/0314934 A1 Dec. 25, 2008

(30) Foreign Application Priority Data

Apr. 8, 2005 (FR) ..... 05 03542

(51) Int. Cl.
*B65D 88/54* (2006.01)
*B65D 5/72* (2006.01)

(52) U.S. Cl. ..... 222/321.9; 222/380; 222/321.7; 222/494

(58) Field of Classification Search ..... 222/494, 222/496, 321.1–321.9, 256, 383.1, 547, 212, 222/213, 380, 402.1, 375
See application file for complete search history.

(56) References Cited

U.S. PATENT DOCUMENTS

| | | | | |
|---|---|---|---|---|
| 3,602,407 | A * | 8/1971 | Grothoff | 222/494 |
| 4,227,650 | A * | 10/1980 | McKinney | 239/333 |
| 4,230,242 | A * | 10/1980 | Meshberg | 222/321.2 |
| 4,830,284 | A * | 5/1989 | Maerte | 239/333 |
| 4,921,142 | A * | 5/1990 | Graf et al. | 222/162 |
| 5,190,190 | A | 3/1993 | Fudalla | |
| 5,207,659 | A * | 5/1993 | Pennaneac'h et al. | 604/298 |
| 5,370,317 | A * | 12/1994 | Weston | 239/533.14 |
| 6,234,365 | B1 * | 5/2001 | Bougamont et al. | 222/494 |
| 6,443,370 | B1 * | 9/2002 | Brulle et al. | 239/333 |
| 7,306,129 | B2 * | 12/2007 | Swiss et al. | 222/494 |
| 7,448,559 | B2 * | 11/2008 | Le Maner et al. | 239/463 |

FOREIGN PATENT DOCUMENTS

FR 2 292 526 A 6/1976

* cited by examiner

*Primary Examiner*—Kevin P Shaver
*Assistant Examiner*—Stephanie E Tyler
(74) *Attorney, Agent, or Firm*—Sughrue Mion, PLLC

(57) ABSTRACT

A dispenser head for mounting on an actuator rod of a fluid dispenser member. The actuator rod is displaceable up and down along an axis. The dispenser head includes a bearing surface for displacing the dispenser head and for actuating the fluid dispenser member. The head further includes a dispenser endpiece that internally defines an endpiece channel that opens out to the outside at a dispenser orifice. The endpiece presents an elongated configuration with a connection end connected to the remainder of the head and a free end. The dispenser orifice is situated in the proximity of the free end. The dispenser orifice is provided with internal closure member that is suitable for selectively closing the dispenser orifice from the inside.

18 Claims, 3 Drawing Sheets

DISPENSER HEAD

BACKGROUND OF THE INVENTION (1) Field of the Invention

The present invention relates to a fluid dispenser head for mounting on, or associating with, a dispenser member. In general, the dispenser member comprises an actuator rod that internally defines a flow channel through which the fluid is delivered to the dispenser head. The rod is axially displaceable down and up along a generally-vertical, longitudinal axis. The dispenser member can be in the form of a pump or a valve including a body inside which the actuator rod is mounted so as to be displaced down and up against the action of a return spring that tends to return the actuator rod into a rest position. The dispenser head is thus associated with a pump or a valve so as to constitute a fluid dispenser that is also provided with a fluid reservoir from which the pump or the valve takes the fluid so as to be dispensed through the head. Such dispenser heads are frequently used in the fields of perfumery, cosmetics, or even pharmacy.

(2) Description of Related Art

In general, such dispenser heads comprise an axial connection sleeve for engaging on the free end of the actuator rod. In addition, the head further comprises a dispenser endpiece defining an endpiece channel that is connected to the connection sleeve via a connection channel. The endpiece includes a free dispenser end defining a dispenser orifice that is situated at a downstream end of the endpiece channel. The other end of the endpiece is connected to the remainder of the head. The head further comprises a bearing surface on which axial pressure can be exerted so as to drive in the actuator rod. The dispenser head therefore fulfils both a pushbutton function and a dispensing function. That type of dispenser head is already known in the prior art. It includes a dispenser endpiece that slopes relative to the longitudinal displacement axis. As a result of the slope of the dispenser endpiece, the dispenser head is difficult to manufacture: given that the head is made by molding, the slope of the endpiece requires a relatively complicated mold that is not displaceable along a single axis.

BRIEF SUMMARY OF PREFERRED EMBODIMENTS OF THE INVENTION

An object of the present invention is to simplify the manufacture of such a dispenser head. Another object of the invention is to provide the dispenser head with an applicator function for applying fluid to an application surface. Another object is to guarantee preservation of the fluid inside the head, even in the proximity of the dispenser orifice. Another object is to simplify the assembly of such a dispenser head. Another object is to make the dispenser head with as few component parts as possible.

To achieve these objects, the present invention provides a dispenser head for mounting on the actuator rod of a fluid dispenser member, the rod being displaceable down and up along an axis, the head comprising a bearing surface for displacing the head and for actuating the dispenser member, the head further comprising a dispenser endpiece that internally defines an endpiece channel that opens out to the outside at a dispenser orifice, said endpiece presenting an elongate configuration with a connection end connected to the remainder of the head and a free end, the dispenser orifice being situated in the proximity of the free end, the head being characterized in that the dispenser orifice is provided with internal closure means that are suitable for selectively closing the dispenser orifice from the inside.

This implies that a closure member is situated upstream of the dispenser orifice, in such a manner as to be able to close it from the inside. The dispenser orifice advantageously presents a definitive shape that can be deformed little, if at all, and it is the displacement of the closure member that makes it possible to define a passage for the fluid coming from the endpiece channel. As a result, this implies that the closure member is an element that is separate from the dispenser orifice. The closure member is advantageously displaceable inside the dispenser endpiece, in such a manner as to be able to close the dispenser orifice selectively from the inside.

According to another advantageous characteristic of the invention, the dispenser orifice is situated laterally along the length of the endpiece, the free end being closed. This is a characteristic that can be implemented regardless of whether or not the endpiece integrates internal closure means. The lateral disposition of the dispenser orifice makes it possible to use the endpiece as an applicator, receiving, at least temporarily, the dose of fluid that has been dispensed by the dispenser head. This is not possible when the dispenser orifice is situated at the free end of the endpiece.

In a non-limiting embodiment of the invention, the endpiece channel contains a elastically-deformable element that extends from the connection end to the dispenser orifice where it forms a closure member that is suitable for closing the orifice in leaktight manner, said closure member being displaceable along a direction that is substantially perpendicular to the length of the endpiece. The deformable element advantageously comprises a flexible spout that is adapted to deform in the endpiece channel under the effect of the fluid under pressure in said channel. In a practical embodiment, the head comprises a substantially-rigid inner core and a substantially-flexible outer casing, the core being engaged in the casing, the casing forming the endpiece and the core forming the closure means. The core advantageously forms a body in leaktight engagement in the casing, and the core also forms an elongate flexible spout that extends from the body inside the endpiece to the dispenser orifice where it forms a closure member for closing the dispenser orifice, the spout being thin enough and long enough to impart a certain amount of elastic deformability thereto. The body of the core preferably defines a collar in leaktight engagement in the casing and a connection sleeve for mounting on an actuator rod of a dispenser member, the body further forming a connection duct that connects the connection sleeve to the endpiece channel.

According to another characteristic of the invention, the bearing surface intersects the axis, the endpiece extending axially, being offset away from the axis. The endpiece preferably includes an inner face facing the axis X and an outer face, the dispenser orifice being formed in the outer face.

In a non-limiting second embodiment of the invention, the endpiece comprises: an inner tube that internally defines the endpiece channel, the tube defining an outlet opening in the proximity of the free end; and, surrounding the tube, a sheath forming the dispenser orifice, the outlet opening of the tube being separated from the dispenser orifice of the sheath by a leaktight contact zone that is suitable for being open, thereby creating a passage between the opening and the orifice under the effect of fluid under pressure in said endpiece channel. The sheath is advantageously elastically deformable. In a variant, the tube is elastically deformable. The sheath preferably bears in leaktight contact against the tube, at least around the dispenser orifice. The outlet opening is advantageously formed at the free end of the tube, whereas the dispenser orifice is formed laterally on the sheath, its free end being closed. Some of the characteristics of the first embodiment can also be implemented in the second embodiment.

In a variant, the endpiece is elastically deformable and bears, at its dispenser orifice, against a closure member that is housed inside the endpiece. The closure member is advantageously formed by a spout that is preferably rigid, that extends in the endpiece channel, and that is formed by the core.

In all three embodiments, the dispenser orifice is selectively closed from the inside either by the closure member formed at the free end of a flexible or rigid spout, or by the inner tube in leaktight contact around the dispenser orifice. It should be observed that the internal closure means are implemented in the proximity of the difficult-to-access free end of an elongate dispenser endpiece, and this is done without using an additional part other than the parts constituting the dispenser head.

BRIEF DESCRIPTION OF THE DRAWINGS

The invention is described more fully below with reference to the accompanying drawings which show three different embodiments by way of non-limiting example.

In the Figures.

DETAILED DESCRIPTION OF THE PREFERRED EMBODIMENTS

Figure 4:
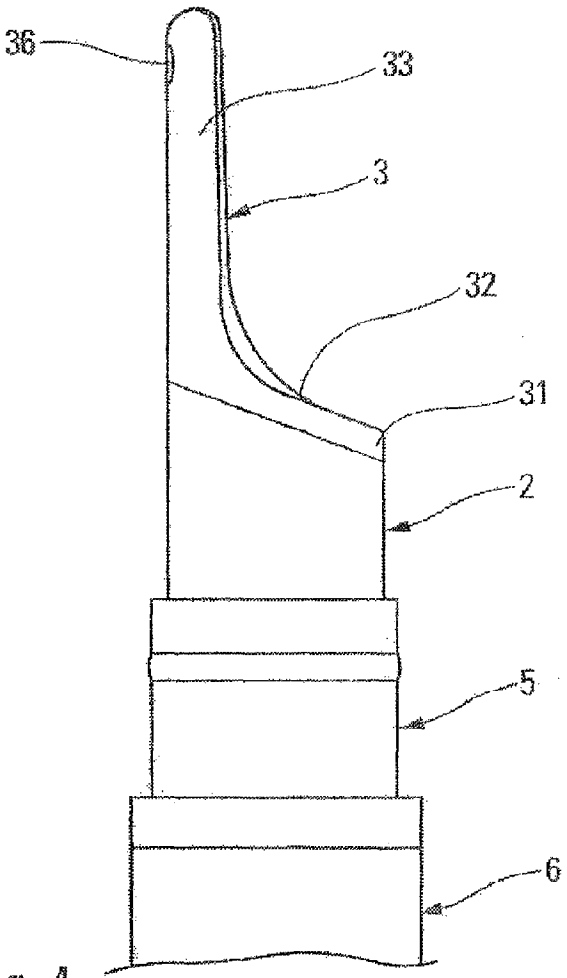
FIG. 4 is a side view of the assembly shown in FIG. 3.
Figure 5:
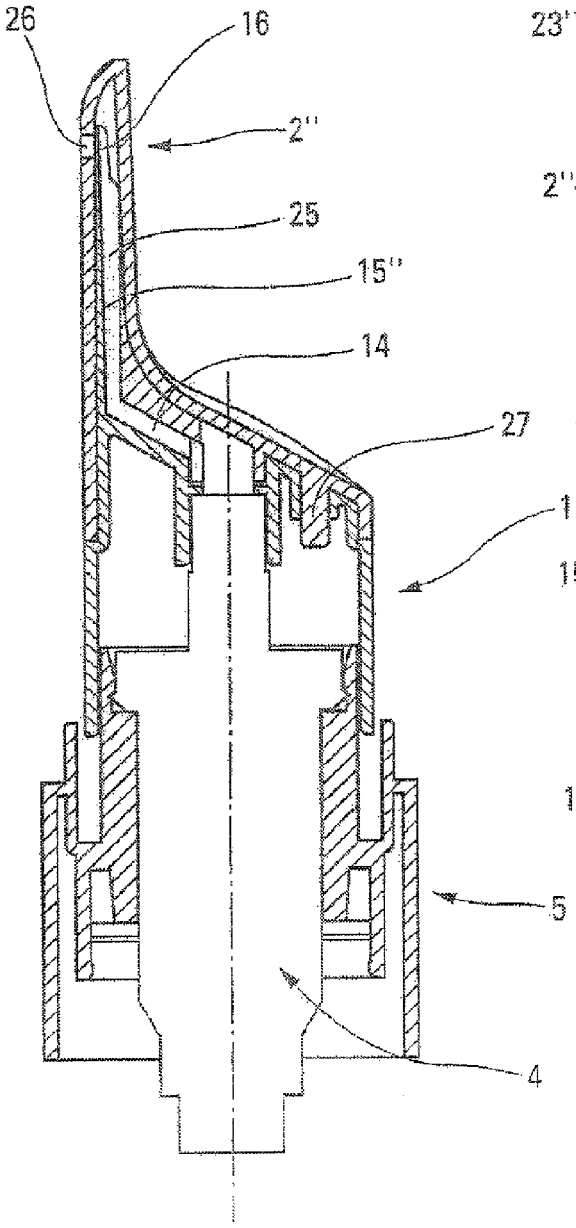
FIG. 5 is a view similar to the view in FIG. 1 for a third embodiment of the invention.
Figure 6:
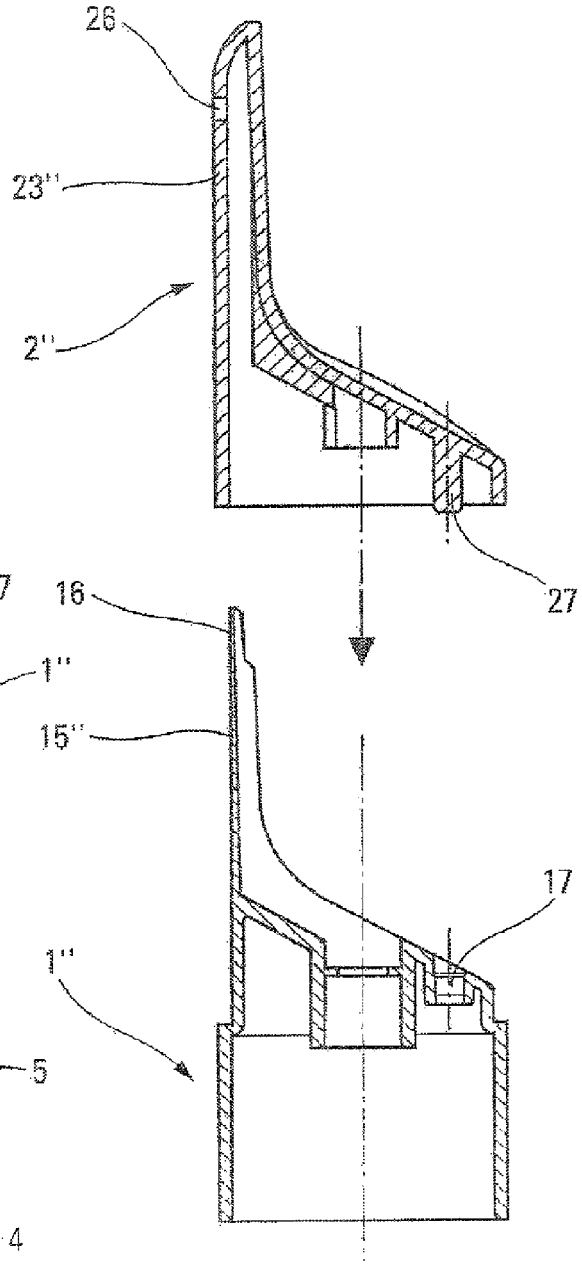
FIG. 6 is an exploded view of the FIG. 5 head.

In the three embodiments in FIGS. 1 to 6, the fluid dispenser heads of the invention are of the "pushbutton" type that are pressed in order to dispense the fluid. The dispenser head is mounted on, or associated with, a dispenser member that can be a pump or a valve. In the drawings, the dispenser member is designated by the numerical reference 4. The dispenser head is designated by the numerical references 1, 2 in FIGS. 1 and 2, since it is constituted by two distinct elements, namely a core 1, and a casing 2, and it is designated by the numerical references 1', 2', 3 in FIGS. 3 and 4, since it is constituted by a core 1', a casing 2', and a sheath 3. In FIGS. 5 and 6, the head comprises two parts, namely a core 1", and a casing 2".

The dispenser member 4 comprises a body 40 forming a collar 41 that is engaged in a fastener ring 5. The dispenser member also comprises an actuator rod 43 that is mounted to be displaced down and up inside the body 40. The actuator rod is urged into its rest position by a return spring (not shown). The actuator rod defines an internal flow channel through which there flows the fluid that is put under pressure in the pump body, so as to be dispensed through the dispenser head. The rod extends and is displaced along a longitudinal actuation axis X that can coincide with the axes of symmetry of the receptacle, of the ring, and of the body of the dispenser member.

The fastener ring 5 comprises a housing 51 for receiving the body 40 of the dispenser member 4, and a fastener ring 52 that is engaged on the neck 61 of a receptacle 6 defining an internal reservoir 60. The receptacle comprises substantially a cylinder inside which there can slide a follower-piston or scraper (not shown). That is one particular kind of receptacle, in which the internal volume of the reservoir decreases as the fluid is dispensed by the dispenser member. However, other types of receptacle, having fixed or variable capacity, can be used in the context of the invention.

The type of dispenser member, of fastener ring, and of receptacle is not critical to the present invention. It suffices for the dispenser member to be provided with an actuator rod that is displaceable down and up, and that defines an internal flow duct.

Figure 2:
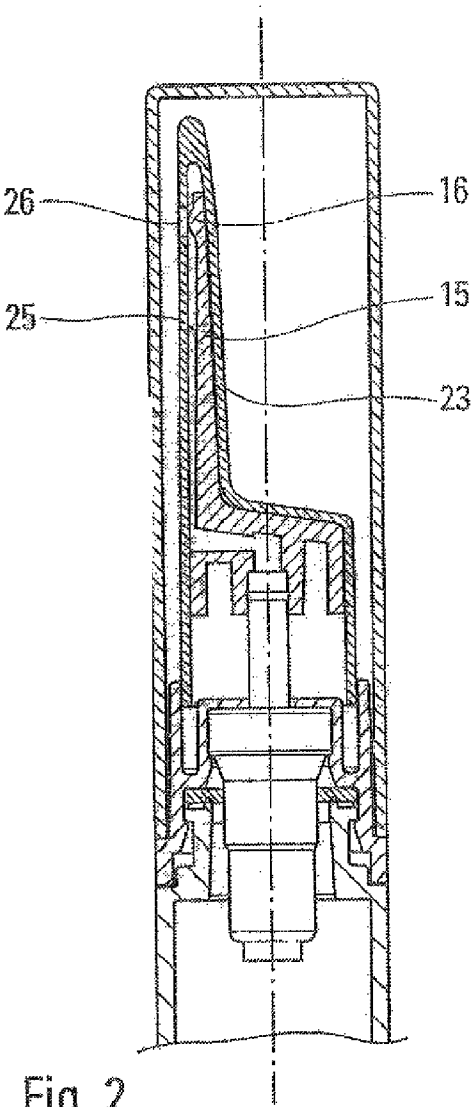
FIG. 2 is a view similar to the view in FIG. 1 with the dispenser head in the open, dispensing position.
Figure 1:
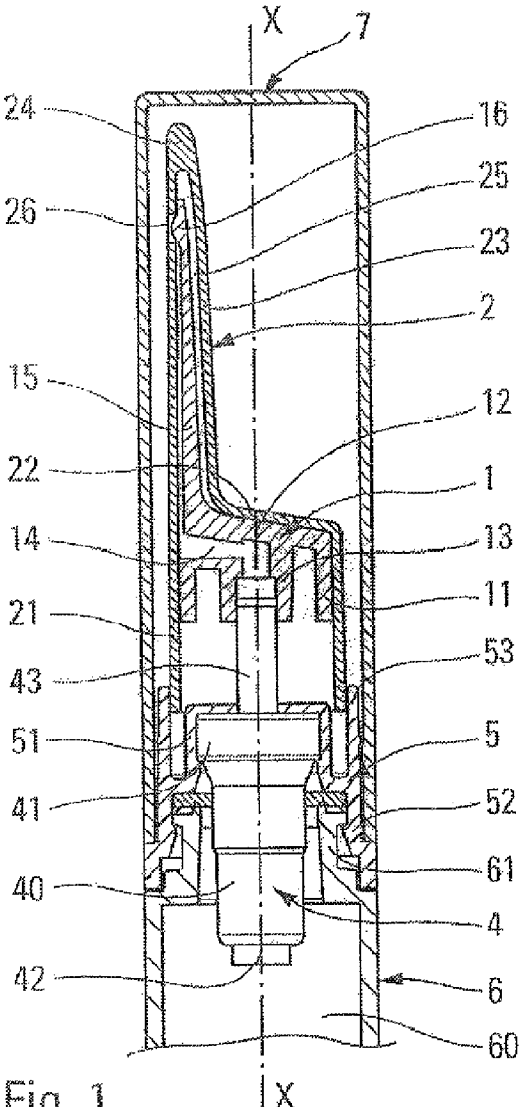
FIG. 1 is a vertical section view through a dispenser head constituting a first embodiment of the invention mounted on a dispenser member associated with a reservoir, the dispenser head being in the closed, rest position.

The dispenser head in the first particular non-limiting embodiment of the invention shown in FIGS. 1 and 2 therefore comprises a core 1, and a casing 2. The core 1 is advantageously made of a substantially rigid material, whereas the casing 2 is advantageously made of a relatively flexible and elastically-deformable material. The core and the casing can be made of conventional plastics materials, such as polyethylene, polypropylene, and thermoplastic elastomers. Making the dispenser head both from a core and from a casing should not be considered as limiting. A dispenser head of the invention could also be made as a single part, or it could even be made of more than two parts. However, in the embodiment shown in FIGS. 1 and 2, the head comprises both a core and a casing.

The core 1 is preferably made as a single part by injection-molding plastics material. The core 1 includes a substantially cylindrical collar 11 having a section that is preferably circular. The collar 11 is closed at its top end by a bearing plate 12 that extends in sloping manner relative to the axis of the cylinder formed by the collar. In addition, the axis of the cylinder coincides with the longitudinal actuation axis X of the actuator rod 43. At its highest portion, the bearing plate 12 is provided with a spout 15 that projects axially upwards along the axis X, but is offset away from the axis. The spout extends upwards in register with the outer wall of the collar 11, as can be seen clearly in FIGS. 1 and 2. The spout is connected to the remainder of the body at its connection bottom end and defines a free top end. The spout 15 is relatively long and thin such that it is elastically deformable, with a maximum amplitude at its free end. The spout forms a closure member 16, e.g. in the form of a bead that projects laterally, radially outwards. The core 1 also forms a connection sleeve 13 that internally forms an inlet duct. The sleeve is generally cylindrical in shape, with a cylinder axis that coincides with the axis X of the actuator rod once the dispenser head is mounted on the actuator rod. The free end of the actuator rod 43 is engaged inside the sleeve 13. The inlet duct of the sleeve is extended by a connection duct 14 that opens out at the collar 11, just below the spout 15.

The casing 2 is preferably made as a single part from a molded plastics material, such as thermosplastic elastomer. The casing 2 includes a skirt 21 that is substantially circularly cylindrical. The skirt also extends along the axis X, once it is mounted on the rod. The skirt is closed at its top end by a bearing wall 22 that forms an outer bearing surface. The wall 22 extends in sloping manner relative to the axis X. The angle of slope of the wall 22 relative to the axis X can lie in the range 40° to 90° relative to the axis X, i.e. relative to the vertical. In other words, the bearing wall can be horizontal, or even relatively steeply sloping. Naturally, the steeper the slope, the more the area of the wall 22 increases. The bearing surface is for applying a bearing force by means of one or more fingers of the hand. The greater the area, the easier it is to apply one or more fingers. However, it should be observed that the bearing surface is situated in central manner on the axis X. The bearing wall 22 is situated axially downstream from the axial inlet duct 113. In other words, the bearing wall 22 intersects the axis X. The bearing force exerted by the finger of the user is therefore applied directly along the axis X, thereby making it possible to guarantee good distribution of the bearing force on the head during dispensing. Although it is made of flexible material, the bearing wall cannot deform, given that it is in contact with the bearing plate 12 formed by the rigid core 1.

At is highest point, the bearing wall 22 forms a dispenser endpiece 23 that internally defines an endpiece channel 25. The endpiece 23 is connected at its bottom end to the remainder of the casing, and defines a free top end 24 that is closed. The endpiece projects axially upwards, and is offset away from the axis X. The dispenser endpiece extends in axial and offset manner, i.e. parallel to the axis X. In particular, it can be seen in FIGS. 1 and 2 that the dispenser endpiece 24 extends in offset manner in register with the tangent or the edge of the skirt 21: the outer wall of the endpiece is completely in alignment with the outer wall of the skirt on the left-hand portion, as can be seen in FIGS. 1 and 2. It should also be observed that the endpiece 23 is inscribed within the outline of the skirt 21. In other words, the endpiece does not project radially outwards relative to the skirt when the casing is observed from above or from below along the axis X. This is a characteristic that can be protected regardless of whether or not the dispenser head is made of two parts. In particular, it is possible to imagine a dispenser head forming both a bearing surface, and an axially-offset dispenser endpiece that lies within or that is inscribed within the outline of the base skirt of the dispenser head. As a result of the endpiece extending in axial manner, it is easy to mold, to unmold, and to assemble the part. The inside of the dispenser head can be molded using a single mold core. In addition, the dispenser head can be made as a single part. When the head is made of two parts, i.e. with a core 1 and a casing 2, as in the embodiment shown in the figures, the axial orientation of the endpiece inscribed within the outline of the skirt also makes it easy and simple to assemble the core 1 inside the casing 2. Assembly can be performed by engaging the core 1 in the casing 2 in completely axial manner. The rigid collar 11 comes into leaktight engagement inside the skirt 21, whereas the plate 12 comes into contact with the bearing wall 22. The endpiece 23 also forms a dispenser orifice 26 that is situated in the proximity of the free end, but not at the free end. On the contrary, the orifice opens out laterally below the free end, on the face of the endpiece facing away from the axis X.

The spout 15 is engaged in the channel 25 of the endpiece 23 such that its closure member 16 is situated at the dispenser orifice 26.

As a result of the elastic deformability of the spout, said spout is displaceable inside the endpiece channel along a direction that is substantially perpendicular to the axis X. As a result, the closure member can be displaced in the endpiece in such a manner as to close the dispenser orifice hermetically from the inside.

The endpiece 23, formed by the flexible casing 2, presents a certain amount of flexibility or suppleness, in spite of the presence of the spout, since said spout is also flexible as a result of its length.

In addition, the endpiece 23 advantageously presents a flat spatula shape. The endpiece is wider circumferentially than it is radially.

By making the endpiece 23 in the form of a flat spatula that is advantageously elastically deformable, it is possible to use the endpiece as a fluid applicator for applying and/or spreading the fluid on an application surface.

Furthermore, the completely or substantially axially-offset orientation of the endpiece, advantageously with a bearing surface that is completely centered on the axis, makes it possible to obtain good positioning accuracy in dispensing and applying the fluid on an application surface.

It is also advantageous for the bottom end of the skirt 21 to extend inside a bushing 53 formed by the fastener ring 5. Thus, the actuator rod 43 is not visible.

Figure 3:
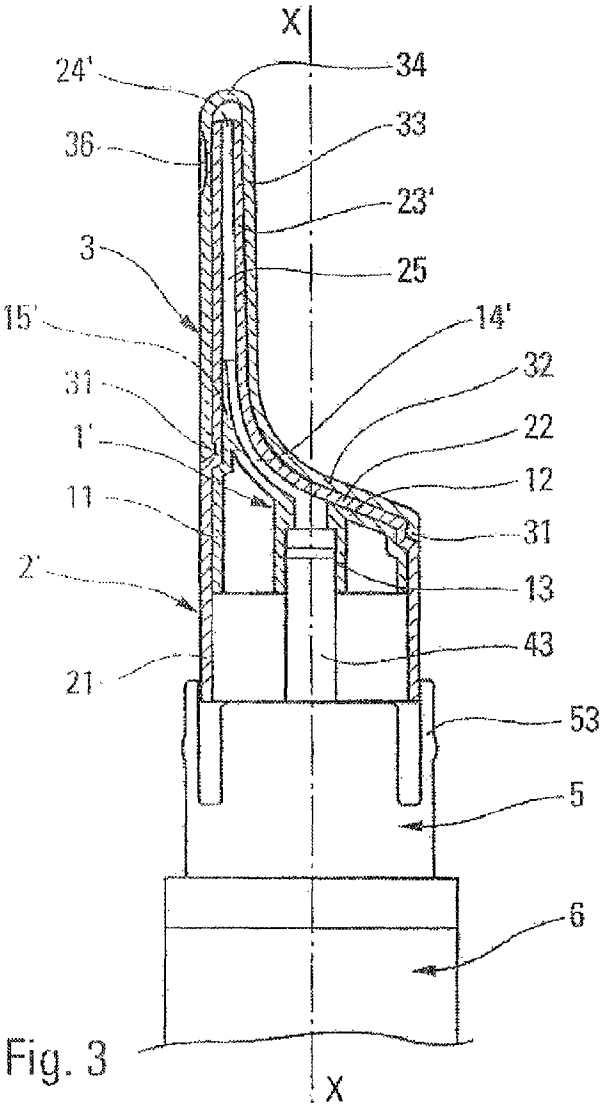
FIG. 3 is a diagrammatic vertical section view through a dispenser head constituting a second embodiment of the invention associated with a pump mounted on a reservoir.

Reference is made below to FIGS. 3 and 4 in order to describe the non-limiting second embodiment of the invention. In this second embodiment, the dispenser head comprises three component elements, namely a core 1', a casing 2', and a sheath 3.

The core 1' can be made of a relatively rigid plastics material, and, as in the first embodiment, can comprise a connection sleeve 13 in engagement with the free end of the actuator rod 43. The core 1' also comprises a collar 11 that coaxially surrounds the connection sleeve 13. The collar 11 is extended by a bearing plate 12 where the inlet duct formed by the sleeve 13 opens out. The bearing plate also forms a groove 14' that defines a connection duct. The core 1' also forms a truncated spout 15' in which the groove 14' also extends.

The casing 2' can be made of a material that is relatively flexible or substantially rigid. The casing 2' also comprises a skirt 21 that is closed by a wall 22 that bears against the bearing plate. The wall 22 also intersects the axis X. The casing also comprises an inner tube 23' that extends axially, and is offset away from the axis X. The inner tube 23' includes an outlet opening 24' at its free top end.

The body 1' is engaged in the casing 2' in the same way as in the first embodiment. A difference resides in the fact that the connection duct is formed by the groove 14' that is closed over by the casing. The truncated spout 15' does not extend as far as the free end of the tube 23'.

In this second embodiment, the sheath 3 constitutes an additional element that can be made of a material that is substantially rigid or relatively flexible. The sheath 3 comprises an anchor skirt 31 that comes into engagement around the casing 2. Starting from the anchor skirt 31, the sheath forms a bearing surface 32 on which the user can exert axial pressure along the axis X. The sheath also comprises a sort of sleeve or bushing 33 that extends all around the inner tube 23'. The sleeve 33 is closed at its top end 34, but forms a dispenser orifice 36 that opens out laterally or radially on the side that is remote from the axis X. The tube 23' is in intimate contact with the inner wall of the sleeve 33, such that together they form a leaktight contact zone all around the dispenser orifice 36. This corresponds to the rest position. In contrast, while the fluid is under pressure inside the inner tube 23', a passage is created between the tube 23' and the sleeve 33, such that the fluid finds an outlet path towards the dispenser orifice 36. The outlet passage can be created as a result of the tube 23' and/or the sleeve 33 being elastically deformable. The tube 23' and the sheath 3 are preferably elastically deformable in such a manner as to impart a certain amount of flexibility or suppleness to the endpiece.

In FIGS. 5 to 6 there can be seen a third embodiment of a dispenser head of the invention that can be considered as a variant to the first embodiment in FIGS. 1 and 2. The head comprises a core 1", and a casing 2". The core forms a spout 15" that is preferably relatively rigid. The spout is engaged in the endpiece 23" formed by the casing, but deforms little, if at all, inside the endpiece as a result of its rigidity. On the contrary, it is the endpiece 23" that is deformable. In the rest position (FIG. 5), the spout 15" closes the dispenser orifice 26 with its free end that forms a closure member 16. The closure member 16 comes into leaktight contact around the dispenser orifice inside the endpiece channel. The leaktight contact is broken when the pressure in the channel exceeds a threshold. Another difference with the first embodiment resides in the fact that the connection duct is formed between the core and the casing. Another distinctive feature resides in the anchor heel 27 of the casing 2" in engagement in the housing 17 of the core. The heel holds the casing more securely on the core. It should also be observed that it is the core that forms the skirt that extends as far as to around the fastener ring 5.

In all three embodiments, the dispenser orifice, that is advantageously formed laterally, is closed from the inside by a closure member that is displaceable inside the endpiece, relative to the dispenser orifice, along a direction that is substantially perpendicular to the axis X.

The invention claimed is:

1. A dispenser head for mounting on an actuator rod (43) of a fluid dispenser member (4), the actuator rod being displaceable down and up along an axis (X), the dispenser head comprising a bearing surface (22) for displacing the dispenser head and for actuating the fluid dispenser member, the dispenser head further comprising a dispenser endpiece (23; 23', 33; 23") that internally defines an endpiece channel (25) that opens out to the outside at a dispenser orifice (26; 36), said endpiece comprising an elongated configuration with a connection end connected to the dispenser head and a free end (24; 34), the dispenser orifice being situated in the proximity of the free end, wherein the dispenser orifice comprises internal closure means (16; 23') for selectively closing the dispenser orifice from the inside;

wherein the endpiece extends parallel to the axis (X); and wherein the bearing surface (22) intersects the axis (X), the endpiece extending axially, being offset away from the axis (X).

2. A dispenser head according to claim 1, in which the dispenser orifice (26; 36) is situated laterally along the length of the endpiece, the free end (24; 34) being closed.

3. A dispenser head according to claim 1, in which the endpiece channel (25) contains a elastically-deformable element (15) that extends from the connection end to the dispenser orifice (26) where it forms a closure member (16) that is suitable for closing the orifice in leaktight manner, said closure member being displaceable inside the endpiece along a direction that is substantially perpendicular to the length of the endpiece.

4. A dispenser head according to claim 1, in which the deformable element comprises a flexible spout (15) that is adapted to deform in the endpiece channel (25) under the effect of the fluid under pressure in said channel.

5. A dispenser head according to claim 1, comprising a substantially-rigid inner core (1) and a substantially-flexible outer casing (2), the core being engaged in the casing, the casing forming the endpiece (23) and the core forming the closure means (15, 16).

6. A dispenser head according to claim 5, in which the core (1) forms a body in leaktight engagement in the casing, and the core also forms an elongate flexible spout (15) that extends from the body inside the endpiece to the dispenser orifice (26) where it forms a closure member (16) for closing the dispenser orifice, the spout being thin enough and long enough to impart a certain amount of elastic deformability thereto.

7. A dispenser head according to claim 6, in which the body of the core defines a collar (11) in leaktight engagement in the casing and a connection sleeve (13) for mounting on an actuator rod of a dispenser member, the body further forming a connection duct (14) that connects the connection sleeve to the endpiece channel.

8. A dispenser head according to claim 1, in which the endpiece includes an inner face facing the axis (X) and an outer face, the dispenser orifice being formed in the outer face.

9. A dispenser head according to claim 1, in which the endpiece (23") is elastically deformable and bears, at its dispenser orifice, against a closure member (16) that is housed inside the endpiece.

10. A dispenser head according to claim 9, in which the closure member (16) is formed by a spout (15") that extends in the endpiece channel.

11. A dispenser head according to claim 1, in which the endpiece comprises:

an inner tube (23') that internally defines the endpiece channel (25), the tube defining an outlet opening (24') in the proximity of the free end; and a sheath (3) that surrounds the tube, the sheath forming the dispenser orifice (36), the outlet opening of the tube being separated from the dispenser orifice of the sheath by a leaktight contact zone that is suitable for being opened, thereby creating a passage between the opening and the orifice under the effect of fluid under pressure in said endpiece channel.

12. A dispenser head according to claim 10, in which the sheath is elastically deformable.

13. A dispenser head according to claim 10, in which the tube is elastically deformable.

14. A dispenser head according to claim 11, in which the sheath bears in leaktight contact against the tube, at least around the dispenser orifice.

15. A dispenser head according to claim 11, in which the outlet opening is formed at the free end of the tube, whereas the dispenser orifice is formed laterally on the sheath, its free end being closed.

16. A dispenser head for mounting on an actuator rod of a fluid dispenser member, the actuator rod being displaceable down and up along an axis, the dispenser head comprising:

a bearing surface intersecting the axis, the bearing surface configured to receive an actuating force to displace the dispenser head and actuate the fluid dispenser member;

a dispenser endpiece having an elongated configuration that is offset from the axis of the actuator rod and extends in a direction parallel to the axis of the actuator rod, the dispenser endpiece comprising:

a dispenser orifice;

a channel that communicates with the actuator rod and opens out to the outside at the dispenser orifice;

wherein the dispenser orifice is disposed in the proximity of a distal end of the dispenser endpiece;

the dispenser head further comprising a flexible spout configured to selectively close the dispenser orifice from the inside.

17. The dispenser head according to claim 16, wherein the flexible spout is deformed under the effect of fluid pressure such that the flexible spout is moved away from the dispenser orifice when fluid pressure is increased, thereby opening the dispenser orifice.

18. The dispenser head according to claim 16 further comprising a dispenser member with an actuator rod, wherein when the actuator rod is configured to be displaced downward by application of a force on the bearing surface.

* * * * *